US011450962B1

(12) United States Patent
Gustafson et al.

(10) Patent No.: US 11,450,962 B1
(45) Date of Patent: Sep. 20, 2022

(54) MULTIPLEXED ULTRA-WIDEBAND RADIATING ANTENNA ELEMENT

(71) Applicant: Lockheed Martin Corporation, Bethesda, MD (US)

(72) Inventors: Joshua David Gustafson, Littleton, CO (US); W. Neill Kefauver, Littleton, CO (US); Thomas Henry Hand, Littleton, CO (US); Joseph M. Torres, Littleton, CO (US); Thomas Patrick Cencich, Littleton, CO (US); James Steven Harrison, Littleton, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 666 days.

(21) Appl. No.: 16/386,137

(22) Filed: Apr. 16, 2019

Related U.S. Application Data

(60) Provisional application No. 62/812,896, filed on Mar. 1, 2019.

(51) Int. Cl.

| | |
|---|---|
| ***H01Q 5/30*** | (2015.01) |
| ***H01Q 5/50*** | (2015.01) |
| ***H01Q 5/357*** | (2015.01) |
| ***H01Q 21/00*** | (2006.01) |
| ***H01Q 21/06*** | (2006.01) |

(52) U.S. Cl.
CPC ..... *H01Q 5/50* (2015.01); *H01Q 5/357* (2015.01); *H01Q 21/0025* (2013.01); *H01Q 21/064* (2013.01)

(58) Field of Classification Search
CPC .... H01Q 13/085; H01Q 21/064; H01Q 5/357; H01Q 5/50; H01Q 5/35; H01Q 5/364; H01Q 21/0025
See application file for complete search history.

(56) References Cited

U.S. PATENT DOCUMENTS

| | | | | |
|---|---|---|---|---|
| 5,268,701 | A * | 12/1993 | Smith | H01Q 21/24 343/767 |
| 5,557,291 | A * | 9/1996 | Chu | H01Q 13/085 343/725 |
| 8,537,065 | B2 * | 9/2013 | Minard | H01Q 1/521 343/770 |
| 9,077,083 | B1 * | 7/2015 | Freeman | H01Q 21/064 |
| 9,660,333 | B2 * | 5/2017 | Viscarra | H01Q 21/0087 |
| 11,196,184 | B2 * | 12/2021 | Jordan | H01Q 21/0093 |
| 2003/0156064 | A1 * | 8/2003 | Bancroft | H01Q 1/38 343/700 MS |

(Continued)

OTHER PUBLICATIONS

Minard et al.; Cost /Performance Optimized IEEE802.11A/B/G Front End With Integrated Antenna Diversity; 2006 First European Conference on Antennas and Propagation (Year: 2006).*

*Primary Examiner* — Ab Salam Alkassim, Jr.
(74) *Attorney, Agent, or Firm* — BakerHostetler

(57) ABSTRACT

An antenna element includes a radiator element, a plurality of feed circuits and a multiplexing interface. The radiator element can transceive radio-frequency (RF) signals. The feed circuits, which include impedance and multiplexing features, are realized on multiple feed locations of the radiating element feed slot. The multiplexing interface is electrically coupled to the plurality of feed circuits and can multiplex a number of sub-band signals associated with the feed circuits. The multiplexing interface can provide a high isolation between the feed circuits.

18 Claims, 7 Drawing Sheets

(56) References Cited

U.S. PATENT DOCUMENTS

| | | | | |
|---|---|---|---|---|
| 2003/0189515 | A1* | 10/2003 | Jacomb-Hood | H01Q 25/00 342/373 |
| 2006/0256024 | A1* | 11/2006 | Collinson | H01Q 5/42 343/770 |
| 2009/0109104 | A1* | 4/2009 | Ide | H01Q 5/321 343/730 |
| 2009/0121948 | A1* | 5/2009 | Nysen | H01Q 5/364 343/702 |
| 2009/0153425 | A1* | 6/2009 | Le Naour | H01Q 13/085 343/770 |
| 2010/0245207 | A1* | 9/2010 | Robert | H01Q 23/00 343/876 |
| 2011/0175789 | A1* | 7/2011 | Lee | H01Q 1/243 333/17.1 |
| 2012/0169543 | A1* | 7/2012 | Sharma | H01Q 9/0421 342/458 |
| 2014/0159835 | A1* | 6/2014 | Lo Hine Tong | H01P 5/20 333/204 |
| 2015/0215011 | A1* | 7/2015 | Hartenstein | H01Q 1/521 375/267 |
| 2017/0025749 | A1* | 1/2017 | Frye | H01Q 21/22 |
| 2017/0077610 | A1* | 3/2017 | Bongard | H01Q 21/0025 |
| 2017/0214378 | A1* | 7/2017 | Black | H01Q 5/50 |
| 2017/0294705 | A1* | 10/2017 | Khripkov | H01Q 1/38 |
| 2018/0034499 | A1* | 2/2018 | Kwon | H04B 1/0458 |
| 2018/0048049 | A1* | 2/2018 | Toivanen | H01Q 1/2291 |
| 2019/0044223 | A1* | 2/2019 | Lier | H01P 1/2138 |
| 2019/0334225 | A1* | 10/2019 | Lee | H01Q 9/42 |
| 2020/0169002 | A1* | 5/2020 | Waldauer | H01Q 9/285 |
| 2020/0194890 | A1* | 6/2020 | Hung | H01Q 5/50 |
| 2020/0343647 | A1* | 10/2020 | Runyon | H01Q 13/24 |

* cited by examiner

MULTIPLEXED ULTRA-WIDEBAND RADIATING ANTENNA ELEMENT

CROSS-REFERENCE TO RELATED APPLICATIONS

This application claims the benefit of priority under 35 U.S.C. § 119 from U.S. Provisional Patent Application 62/812,896 filed Mar. 1, 2019, which is incorporated herein by reference in its entirety.

STATEMENT REGARDING FEDERALLY SPONSORED RESEARCH OR DEVELOPMENT

Not applicable

FIELD OF THE INVENTION

This invention generally relates to antenna technology, and more particularly, to ultra-wideband radiating antenna elements and Advanced Electronically Scanned Antenna Arrays.

BACKGROUND

An antenna array can be made up of a plurality of radiating elements configured in an array configuration. Each radiating antenna element has to be able to pass one or more radio-frequency (RF) bands across the entire bandwidth of the system. A full bandwidth system may, for example, have a fractional bandwidth of 10:1, where the fractional bandwidth is a ratio of the highest frequency ($f_{max}$) to the lowest frequency ($f_{min}$) of the bandwidth. For a number of applications using wideband systems, the radiating antenna element needs to be low profile (e.g., small compared to a wavelength associated with the highest frequency). The low-profile requirement of the radiating antenna element can exacerbate an impedance-matching bandwidth of the radiating antenna element. However, for many designs, it is desirable to utilize the same aperture for all bands.

Existing full band antenna arrays sacrifice antenna-element efficiency in order to increase bandwidth. Many slot and/or aperture antennas are fed with a coupled microstrip-feedline balun on a single side of the slot, or as a balanced-stripline feed into a balanced-antipodal Vivaldi antenna (BAVA) configuration. Vivaldi antennas are tapered notch antennas having notches that open in an exponential flare shape. This geometry is utilized in many of the AESA concepts to expedite the needed transducer behavior getting signals from space into an electronic circuit.

SUMMARY

According to various aspects of the subject technology, methods and configuration are disclosed for providing a radiating antenna element for use in an ultra-wideband antenna system. The antenna of the subject technology makes use of a microstrip feed network to excite the antenna with different/similar impedances. The disclosed antenna has two or more feedlines that couple into the antenna receptor at multiple feed excitation locations on the antenna in order to increase the bandwidth of the existing antenna to higher than 12:1 fractional bandwidth, and effectively multiplex a broad band of signals at the receptor. Regardless of whether the antenna is embedded in an array or utilized in isolation, the enabling technology is the re-utilization of the excitation point (volume) on the element by different bands with low interaction. Conceptually, this design is challenging because the excitation volume is small and the potential is at a maximum regardless of the desired band.

In one or more aspects, an antenna element includes a radiator element, a plurality of feed circuits and a multiplexing interface. The radiator element can transceive radio-frequency (RF) signals. The feed circuits are realized on different surfaces of the radiator element. The radiator element can be coupled to a multiplexing interface. The multiplexing interface is electrically coupled to the plurality of feed circuits and can multiplex a number of sub-band signals associated with the feed circuits depending on the geometry chosen. The multiplexing interface can provide a high isolation between the feed circuits. In a diplex case, the first feed and the second feed would potentially cross over on impedance between bands so that all but one are approaching an open or possibly a short as the other feed circuit is matched at the same frequency.

In yet other aspects, a method of providing an ultra-wideband antenna element includes providing a radiator element to receive RF signals. The method further comprises implementing a plurality of feed circuits at multiple feed excitation locations on the radiator element, and coupling the radiator element to a multiplexing interface. The multiplexing interface is configured to electrically couple to the feed circuits and to multiplex a plurality of sub-band signals associated with the feed circuits.

In yet other aspects, an ultra-wideband antenna array includes a plurality of ultra-wideband antenna elements. Each of the ultra-wideband antenna elements includes a radiator element and a plurality of feed circuits. The radiator element can transceive RF signals. The feed circuits can be implemented as a multilayer micro-printed circuit board (micro-PCB) coupled to the radiator element or other transmission line technology. Elements can also be configured for polarization control. The radiator element can fit into a multiplexing radiator receptor that can multiplex a plurality of sub-band signals associated with the feed circuits.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

Figure 1B:
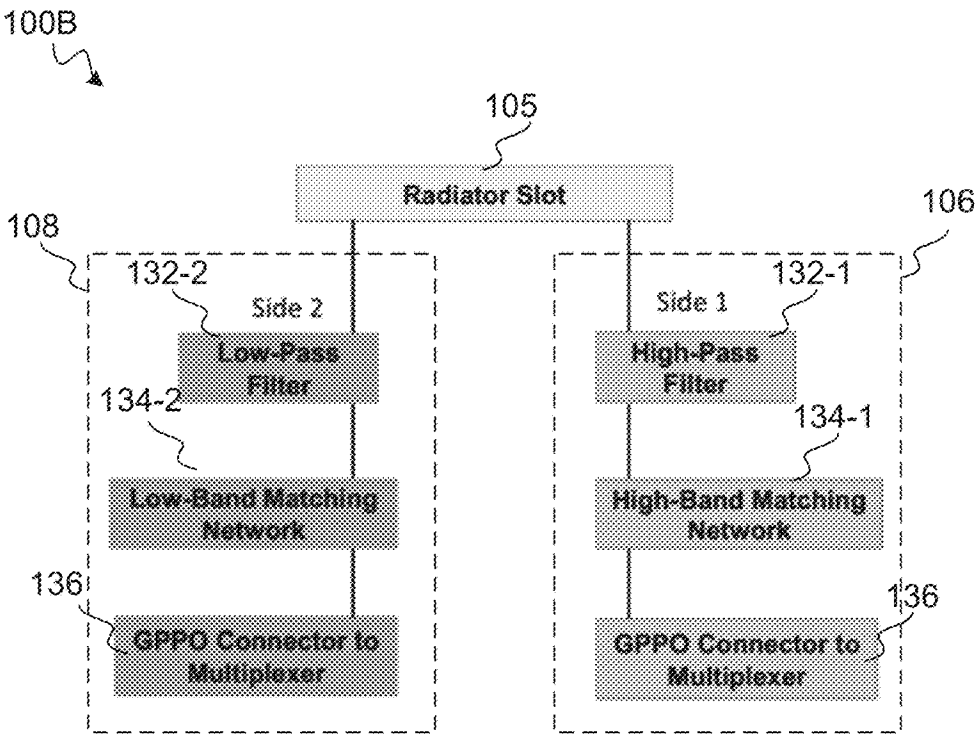
FIG. 1B is a block diagram showing components of the antenna element of FIG. 1A.

The detailed description set forth below is intended as a description of exemplar configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

In some aspects of the subject technology, methods and configurations are described for providing a radiating antenna element for use in an ultra-wideband antenna system by matching the radiating antenna element to support multiple frequency bands. The antenna of the subject technology can be a variation of a tapered slot antenna that makes use of a microstrip feed or other transmission line network. The microstrip feeds of the microstrip feed network excite the antenna with different impedances and are offset in height. The disclosed antenna has two or more feedlines that couple into the antenna receptor (i.e., slot from one of the sides of the antenna element for this geometry). The multiple-side coupling increases the bandwidth of the existing antenna to higher than 12:1 fractional bandwidth, and effectively multiplexes a broad band of signals at the antenna radiating element.

It is understood that multiplexing can create the problem of coupling between frequency bands outside of their intended ranges. To solve this problem, the subject technology implements a matching-network topology to match the element over the greater than 12:1 fractional bandwidth. A simulation approach to the multiplexed-receptor concept is formulated that allows the matching circuit design to be isolated from the adjacent feeds. The antenna design concept of the subject technology supports a plurality of additional feed networks to support phased array electronic scanning over additional bands.

The disclosed antenna solution using receptor multiplexing or multi-impedance receptor excitations offers significant performance advantages over existing solutions in addressing stringent radio-frequency (RF) performance requirements over an ultra-wide bandwidth (e.g., about 4 GHz). For example, the existing solutions proposed in many academic papers that claim to be able to achieve similar bandwidth may suffer from significantly degraded performance such as high losses (VSWR and absorptive), limited scanning capability, and large physical and/or electrical sizes. The antenna of the subject technology achieves a more compact physical and/or electrical size, as well as a lower total loss compared to existing solutions. The disclosed multiplexed-feed concept can be made applicable to other antenna designs to realize similar or extended bandwidth, such as slot antennas, horn antennas and other antenna configurations. Given that the antenna of the subject technology achieves the entire bandwidth continuously using a single element, multiple/separate antenna apertures are no longer needed to accommodate full spectrum coverage, resulting in a significant reduction in Size, Weight and Power (SWaP).

Figure 1A:
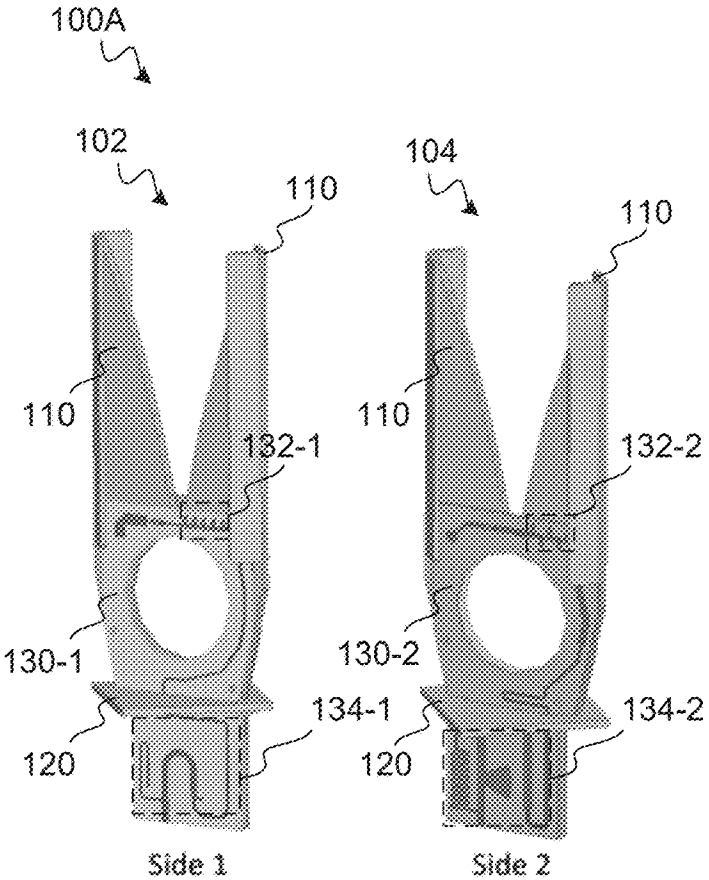
FIG. 1A is a schematic diagram illustrating side views of an example of an antenna element fed on both sides of the slot, according to certain aspects of the disclosure.

FIG. 1A is a schematic diagram illustrating side views 102 and 104 of an example of a double-sided feed antenna element 100A, according to certain aspects of the disclosure. First side view 102 of antenna element 100A shows a first side (side 1) of a radiator element 110, a first feed circuit 130-1, and a ground plane 120. Radiator element 110 can transceive (i.e., transmit and/or receive) RF signals and may be of any suitable type and shape and is not limited to the type and shape, shown in FIG. 1A. First feed circuit 130-1 provides electromagnetic coupling between radiator element 110 and a multiplexing interface and includes a first filter 132-1 and a first matching network 134-1.

Second side view 104 of antenna element 100A shows a second side (side 2) of radiator element 110, a second feed circuit 130-2, and a ground plane 120. Second feed circuit 130-2 provides electromagnetic coupling between radiator element 110 and the multiplexing interface and includes a second filter 132-2 and a matching network 134-2. Antenna element 100A is an ultra-wideband antenna element with a fractional bandwidth of more than 12:1. In one or more implementations, first filter 132-1 and second filter 132-2 are a high-pass filter (HPF) and a low-pass filter (LPF), respectively. In some implementations, first filter 132-1 and second filters 132-2 can be realized using surface-mount passive elements such as capacitors and inductors, or distributed transmission line elements.

Impedance matching networks 134-1 and 134-2 can match an intrinsic impedance of radiator element 110 to an impedance of the multiplexing interface (typically 50 Ohms). The multiplexing interface can be a multiplexing radiator receptor such as a radiator slot and is not shown in FIG. 1A for simplicity. The multiplexing interface can combine the sub-band signals from the LPF and the HPF into a wideband signal. The sub-band signals from the LPF and the HPF are low-band and high-band signals, respectively. The multiplexing interface is designed to provide a high isolation (e.g., better than 25 dB) in the majority of the frequencies within the bandwidth of the radiator element (e.g., 110) while optimizing total antenna efficiency.

In one or more implementations, first and second feed circuits 130-1 and 130-2 may be realized using micro-printed circuit boards (micro-PCBs). In some implementations, a radiator element may have multiple feed excitation locations, and each feed excitation location may include similar feed circuits, as discussed above. In these implementations, the bandwidth of the antenna element is divided into multiple sub-bands, and each feed circuit implemented on a side of the radiator element may include a filter having a suitable pass-band to pass a sub-band signal of the respective sub-band.

In one or more implementations, a multilayer micro-PCB can be coupled to a radiator element (e.g., 110). The multilayer micro-PCB can include multiple feed circuits (e.g., similar to the feed circuits 130) on different layer of the multilayer micro-PCB. The multilayer micro-PCB is then connected to a suitable multiplexing interface (e.g., multiplexing receptor or slot). In some implementations, the multiplexing interface is a receptor (slot) coupled to a suitable wideband RF combiner.

An important aspect of the antenna element 100A is the low-profile feature of the antenna element. For example, the height of the antenna element 100A can be electrically small (less than $\lambda_{cutoff}/8$), a significant miniaturization from a conventional notch of $\lambda_{cutoff}/2$ depth, which approximately represents the lowest frequency of the bandwidth of the antenna element.

FIG. 1B is a block diagram showing components of micro-PCBs of antenna element 100A of FIG. 1A, according to certain aspects of the disclosure. The block diagram of FIG. 1B shows a radiator slot 105 and blocks 106 and 108. Block 106 includes HPF 132-1, first matching network 134-1 (e.g., a high-band matching network) and a connector to multiplexer 136, for example, a sub-miniature push-on micro (SMPM) connector such as a general-purpose push-on (GPPO) connector. Block 108 includes LPF 132-2, second matching network 134-2 (e.g., a low-band matching network) and GPPO connector to multiplexer 136.

Figure 1C:
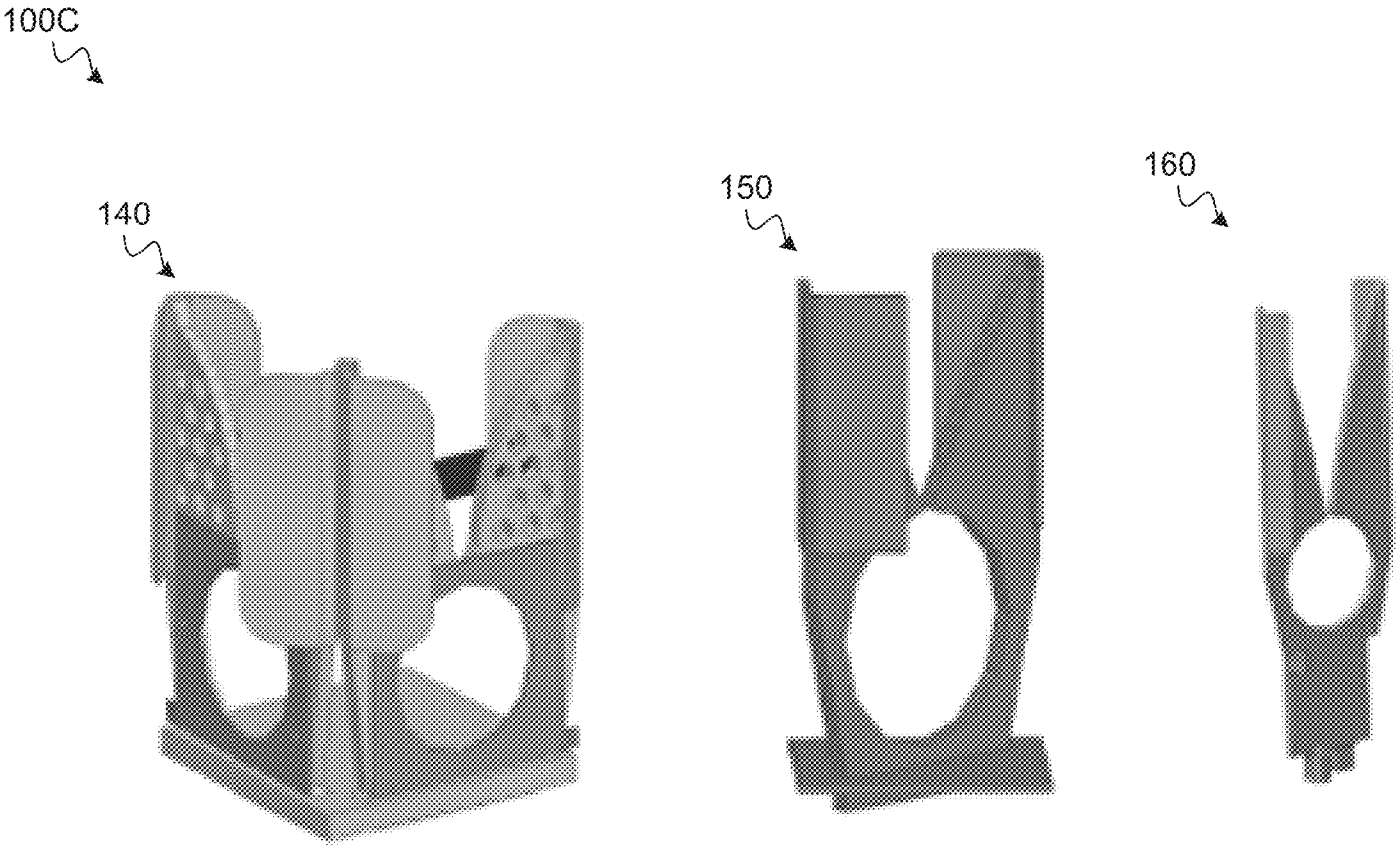
FIG. 1C is a schematic diagram illustrating examples of radiator elements that can be employed to realize double-sided feed antenna elements, according to certain aspects of the disclosure.

FIG. 1C is a schematic diagram illustrating example radiator elements 140, 150 and 160 that can be employed to realize double-sided feed networks, according to certain aspects of the disclosure. Each of radiator elements 140, 150 and 160 can replace radiator element 110 of FIG. 1A. In other words, the disclosed antenna element of the subject technology is not limited to radiator element 110, and separate feed circuits (e.g., 130) can be applied to different sides of any of radiator elements 140, 150 and 160. However, the achievable bandwidth with each of radiator elements 140, 150 and 160 can be different.

Figure 2:
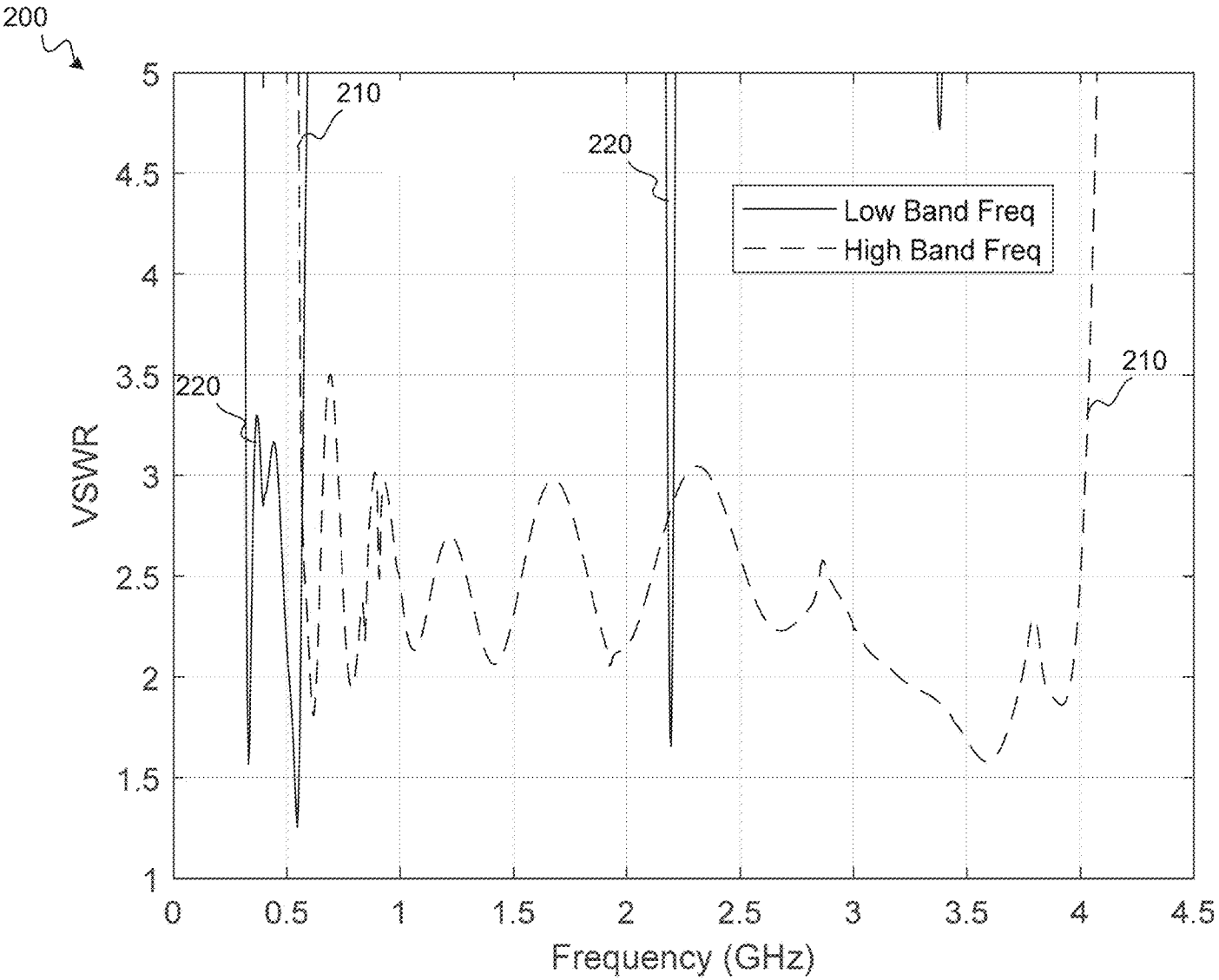
FIG. 2 is a chart illustrating an example of voltage standing-wave ratio (VSWR) plots of low-band and high-band ports of a double-sided feed antenna element, according to certain aspects of the disclosure.

FIG. 2 is a chart 200 illustrating an example of voltage standing-wave ratio (VSWR) plots of low-band and high-band ports of a double-sided feed antenna element, according to certain aspects of the disclosure. The chart 200 includes VSWR plots 210 and 220 in the low-band and high-band regions of frequency, respectively. It should be noted that VSWR plots 210 and 220 represent boresight VSWR values resulting from simulation of an infinite-array of antenna elements. The boresight VSWR is the VSWR value at a boresight of the antenna element, which is an axis of maximum gain (maximum radiated power) of the antenna element.

Figure 3:
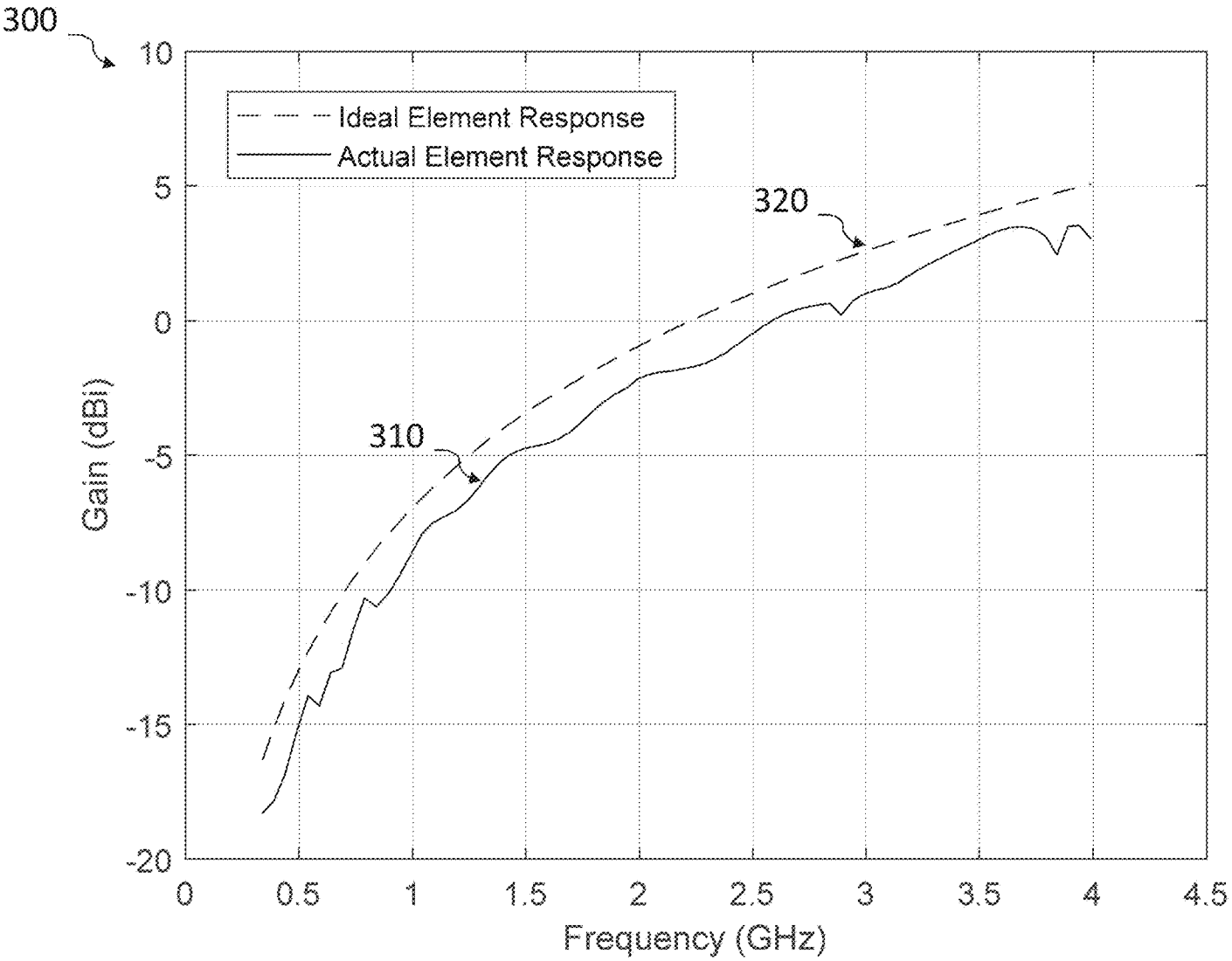
FIG. 3 is a chart illustrating examples of gain-versus-frequency plots of a double-sided feed antenna element, according to certain aspects of the disclosure.

FIG. 3 is a chart 300 illustrating examples of gain-versus-frequency plots 310 and 320 of a double-sided feed antenna element, according to certain aspects of the disclosure. Plot 310 shows a frequency response of an actual antenna element, and plot 320 depicts a frequency response of an ideal antenna element with an equivalent aperture size. The frequency response shown by plots 310 is boresight gain versus frequency, and 320 is the equivalent approximated gain for a particular aperture size. Variation of the boresight gain of the actual antenna element closely follows the boresight gain of the ideal antenna element.

Figure 4:
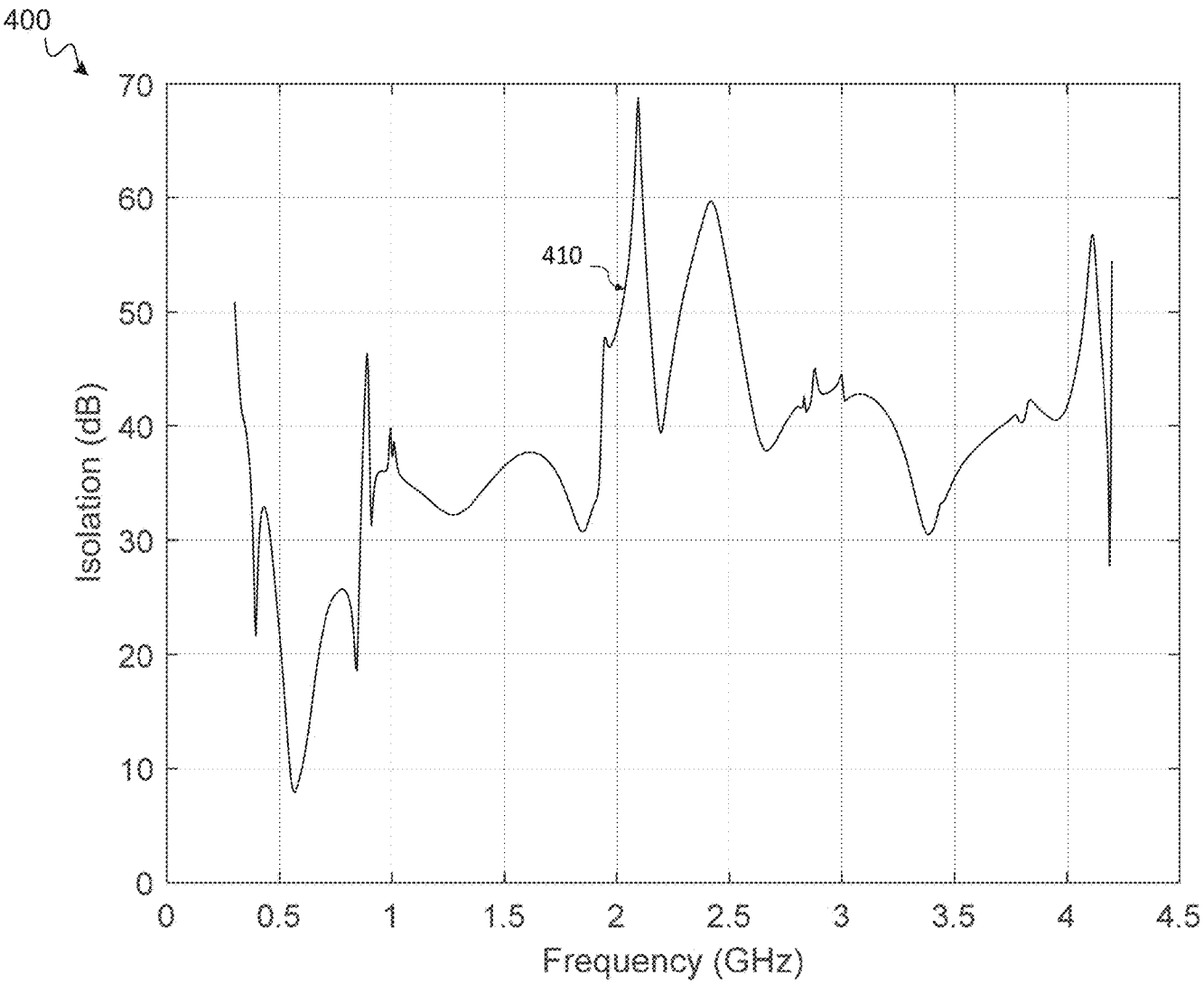
FIG. 4 is a chart illustrating an example of a high-band feed to low-band feed coupling of a double-sided feed antenna element, according to certain aspects of the disclosure.

FIG. 4 is a chart 400 illustrating an example of a high-feed to low-feed coupling of a double-sided feed antenna element, according to certain aspects of the disclosure. Chart 400 shows a plot 410 of coupling versus frequency between the high-feed (e.g., 130-1 of FIG. 1A) and low-feed (e.g., 130-2 of FIG. 1A). The coupling is seen to be better than 25 dB for the majority of the frequencies of the frequency spectrum, which can be considered as a proof of validity of the multiplexed slot concept disclosed herein.

Figure 5B:
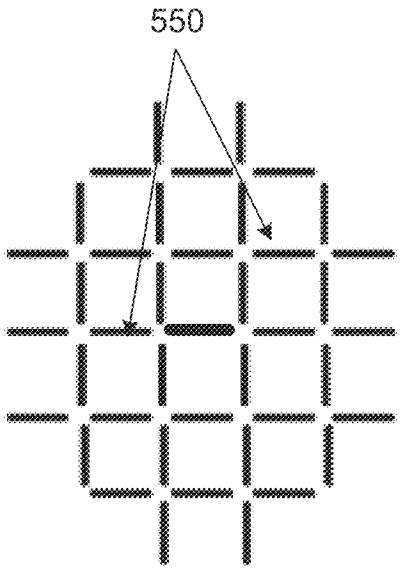
FIG. 5B is a schematic diagram illustrating a top-down view of an example array of multiplexing receptors for an antenna array, according to certain aspects of the disclosure.
Figure 5A:
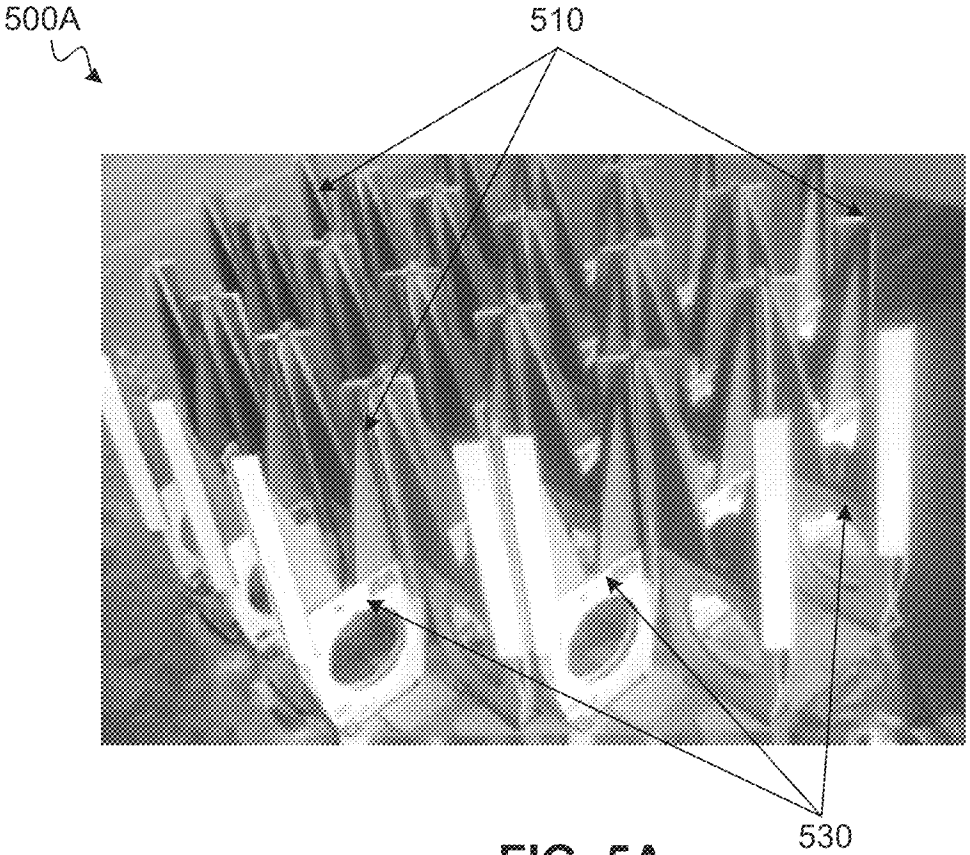
FIG. 5A is a photograph illustrating a perspective view of an example of an antenna array, according to certain aspects of the disclosure.

FIG. 5A is a schematic diagram illustrating a perspective view of an example of an antenna array 500A, according to certain aspects of the disclosure. Antenna array 500A includes a number of antenna elements 510 that are similar to the antenna element 100A of FIG. 1A, and each includes feed circuits 530 (e.g., similar to 130 of FIG. 1A) on both sides of the radiator elements.

FIG. 5B is a schematic diagram illustrating a top view of an example array 500B of multiplexing receptors 550 for an antenna array, according to certain aspects of the disclosure. Multiplexing receptors 550 are radiator slots, each of which can receive an antenna element (e.g., 510 in FIG. 5A). The multiplexing of the low band and high band of the antenna element are multiplexed on the antenna elements themselves. The slot array configuration shown in FIG. 5B is an example configuration and the subject technology is not limited to the configuration of array 500B.

Figure 6:
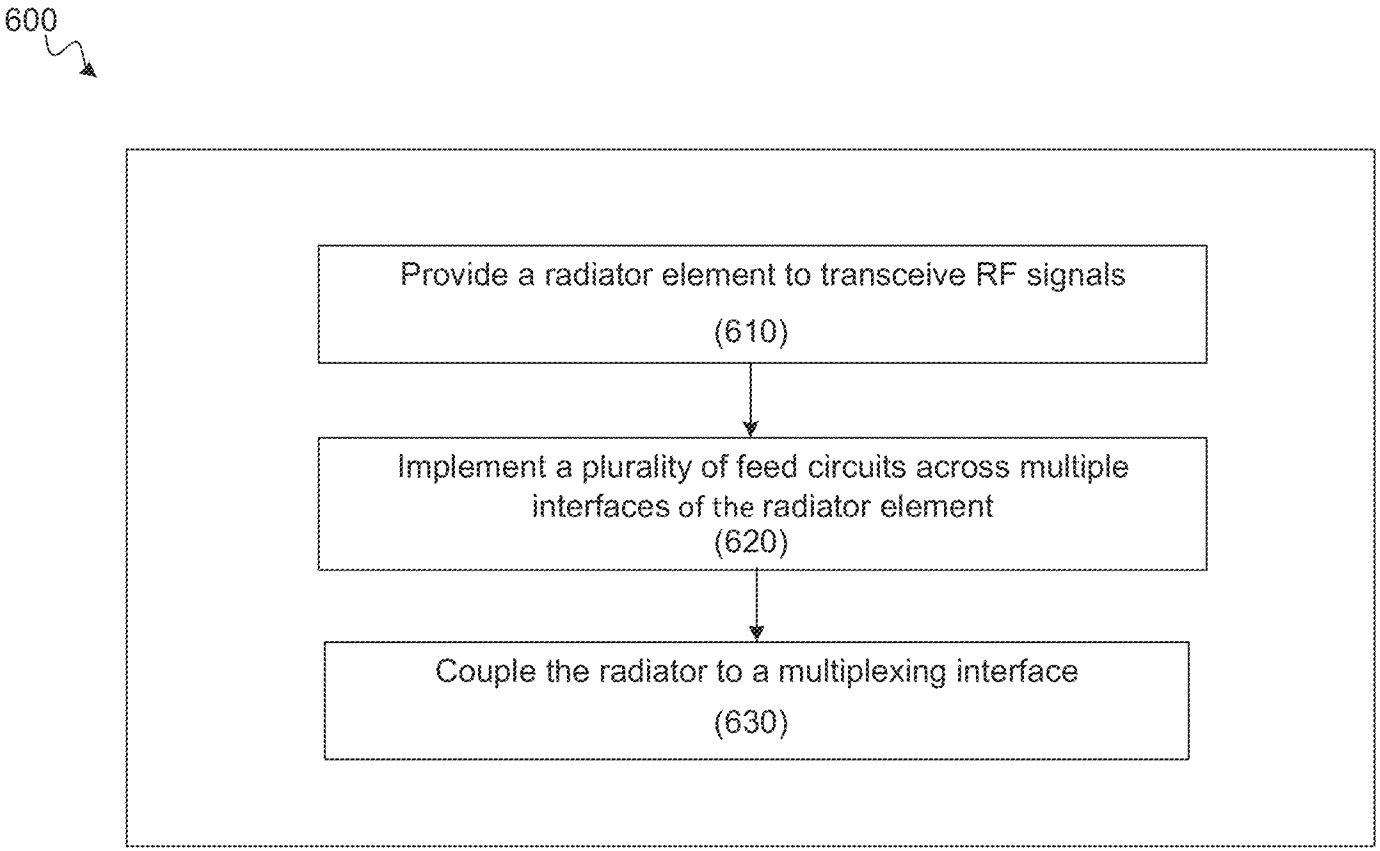
FIG. 6 is a flow diagram of a method of realizing an ultra-wideband antenna element, according to certain aspects of the disclosure.

FIG. 6 is a flow diagram of a method 600 of providing an ultra-wideband antenna element, according to certain aspects of the disclosure. Method 600 includes providing a radiator element (e.g., 110 of FIG. 1A or any of 140, 150 or 160 of FIG. 1C) to transceive RF signals (610). The method further comprises implementing a plurality of feed circuits (e.g., 130-1 and 130-2 of FIG. 1A) at multiple feed excitation locations on the radiator element (620), and coupling the radiator to a multiplexing interface (630). The multiplexing interface is configured to electrically couple to the feed circuits and to multiplex a plurality of sub-band signals associated with the feed circuits.

In some aspects, the subject technology is related to antenna technology, and more particularly, to a multiplexed ultra-wideband radiating antenna element. In some aspects, the subject technology may be used in various markets, including, for example and without limitation, sensor technology, communication systems and radar technology markets.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. An antenna element comprising:

a radiator element configured to transceive radio-frequency (RF) signals; and a plurality of feed circuits integrated with the radiator element, wherein:

the radiator element is configured to be coupled to a multiplexing interface comprising a multiplexing radiator receptor, wherein the antenna element is configured to be fit into the multiplexing radiator receptor, and the multiplexing interface is coupled to the plurality of feed circuits, which are configured to provide electromagnetic coupling between the radiator element and the multiplexing radiator receptor, and is configured to multiplex a plurality of sub-band signals associated with the plurality of feed circuits.

2. The antenna element of claim 1, wherein each of the plurality of feed circuits comprises an impedance matching network and a filter.

3. The antenna element of claim 2, wherein the antenna element comprises an ultra-wideband antenna element having a fractional frequency bandwidth of more than 12:1 and including frequencies of the plurality of sub-band signals.

4. The antenna element of claim 2, wherein the filter is configured to pass frequencies of a respective sub-band signal of the plurality of sub-band signals associated with the plurality of feed circuits.

5. The antenna element of claim 2, wherein the respective matching network is configured to impedance-match an intrinsic impedance of the radiator element to an impedance of the multiplexing interface.

6. The antenna element of claim 1, wherein at least some of the plurality of feed circuits are implemented as transmission line networks.

7. The antenna element of claim 1, wherein the plurality of feed circuits comprises multiple feed circuits coupled into the radiator element.

8. The antenna element of claim 7, wherein the feed circuits are all optimized to operate in the presence of one another.

9. The antenna element of claim 1, wherein the multiplexing interface is configured to provide a high isolation between the plurality of feed circuits.

10. A method of providing an ultra-wideband antenna element, the method comprising:

providing a radiator element to transceive radio-frequency (RF) signals;

implementing a plurality of feed circuits on the radiator element; and coupling the radiator element to a multiplexing interface, wherein the multiplexing interface is configured to electrically couple to the plurality of feed circuits and to multiplex a plurality of sub-band signals associated with the plurality of feed circuits.

11. The method of claim 10, wherein implementing the plurality of feed circuits comprises implementing a plurality of transmission line structures including a plurality of filters and a plurality of impedance matching networks.

12. The method of claim 11, further comprising configuring each filter of the plurality of filters to pass a sub-band signal of the plurality of sub-band signals associated with the plurality of feed circuits.

13. The method of claim 10, wherein implementing the plurality of feed circuits comprises implementing multiple feed circuits across multiple locations along the radiator element, respectively.

14. The method of claim 13, wherein implementing the feed circuits utilize filters to allow the feeds to operate in the presence of one another.

15. The method of claim 10, further comprising configuring the multiplexing interface to provide a high isolation between the plurality of feed circuits.

16. An ultra-wideband antenna array, the antenna array comprising:

a plurality of ultra-wideband antenna elements, each comprising:

a radiator element configured to transceive radio-frequency (RF) signals; and a plurality of feed circuits implemented as a transmission line feed integrated with the radiator element, wherein:

the radiator element is configured to fit into a multiplexing radiator receptor, the plurality of feed circuits are configured to provide electromagnetic coupling between the radiator element and the multiplexing radiator receptor, and the multiplexing radiator receptor is configured to multiplex a plurality of sub-band signals associated with the plurality of feed circuits.

17. The antenna array of claim 16, wherein a fractional bandwidth of the ultra-wideband antenna array is greater than 12:1 and includes frequencies of the plurality of sub-band signals.

18. The antenna array of claim 16, wherein each of the plurality of feed circuits comprises a filter and a respective matching network, and wherein the filter is configured to pass frequencies of a respective sub-band signal of the plurality of sub-band signals associated with the plurality of feed circuits.

* * * * *